US008115705B2

(12) United States Patent
Kawabe

(10) Patent No.: US 8,115,705 B2
(45) Date of Patent: Feb. 14, 2012

(54) DISPLAY DEVICE

(75) Inventor: Kazuyoshi Kawabe, Yokohama (JP)

(73) Assignee: Global OLED Technology LLC, Herndon, VA (US)

( * ) Notice: Subject to any disclaimer, the term of this patent is extended or adjusted under 35 U.S.C. 154(b) by 1160 days.

(21) Appl. No.: 11/568,731

(22) PCT Filed: May 6, 2005

(86) PCT No.: PCT/US2005/015763
§ 371 (c)(1),
(2), (4) Date: Nov. 6, 2006

(87) PCT Pub. No.: WO2005/116970
PCT Pub. Date: Dec. 8, 2005

(65) Prior Publication Data

US 2008/0007499 A1 Jan. 10, 2008

(30) Foreign Application Priority Data

May 17, 2004 (JP) ..... 2004-147073
Jun. 30, 2004 (JP) ..... 2004-195032

(51) Int. Cl.
*G09G 3/30* (2006.01)
*G09G 3/32* (2006.01)

(52) U.S. Cl. ..... 345/76; 345/82

(58) Field of Classification Search ..... 345/87–100, 345/76, 77, 82, 83, 204
See application file for complete search history.

(56) References Cited

U.S. PATENT DOCUMENTS

2003/0043132 A1* 3/2003 Nakamura ..... 345/204
2004/0201581 A1* 10/2004 Miyazawa ..... 345/204

FOREIGN PATENT DOCUMENTS

JP 2003-202834 7/2003
WO WO 97/49080 12/1997
WO WO 03/091977 A1 11/2003

* cited by examiner

*Primary Examiner* — Kevin M Nguyen
(74) *Attorney, Agent, or Firm* — Morgan, Lewis & Bockius LLP

(57) ABSTRACT

An active matrix type display device includes array having pixel circuits arranged in rows and columns matrix form, each pixel circuit includes a current-driven diode type light-emitting element and a plurality of thin-film transistor for controlling the diode type light-emitting element; a data line provided for each column of the matrix for supplying a data signal to the pixel circuits on the corresponding column; data driver for controlling the supply of the data signal to the data line; a gate line provided for each row of the matrix for supplying a selection signal to pixel circuits on the corresponding row; a gate driver for supplying a selection signal to the gate line; and a control circuit for controlling the data driver and gate driver, wherein the data driver switches a plurality of sets of video signals alternately and supplies the video signals to the data line.

3 Claims, 16 Drawing Sheets

| | | V2n−1 | V2n | E1 | E2 | R1 | R2 | $\overline{PRE}$ | DATA |
|---|---|---|---|---|---|---|---|---|---|
| (1) | (2n−1)TH LINE RESET | H | − | H | − | H | H | L | VRST |
| (2) | (2n−1)TH LINE DATE WRITE | H | − | H | − | L | H | H | VDATA |
| (3) | (2n−1)TH LINE ON | L | − | − | − | − | − | − | − |
| (4) | 2nTH LINE RESET | − | H | − | H | H | H | L | VRST |
| (5) | 2nTH LINE DATE WRITE | − | H | − | H | L | H | H | VDATA |
| (6) | 2nTH LINE ON | − | L | − | − | − | − | − | − |

− don't care

Fig. 8

PRIOR ART

DISPLAY DEVICE

FIELD OF THE INVENTION

The present invention relates to an active matrix type display device, and more particularly to one using current driven diode type light-emitting elements.

BACKGROUND OF THE INVENTION

With the progress of computerization in recent years, even portable information terminals are required to have a processing capacity comparable to that of a personal computer in the past. In line with this trend, there is also a demand for video display devices with high definition, high quality and preferably with low-profile, light weight, wide viewing angle and low power consumption.

In response to these requests, a display device with thin-film active elements (thin-film transistor, simply referred to as "TFT") formed on a glass substrate in matrix form and electro-optic elements formed thereon is being actively developed.

The mainstream of the substrates on which active elements are formed is one with a semiconductor film of amorphous silicon or poly-silicon, etc., formed, patterned and connected with metal wires. Due to differences in electrical characteristics of active elements, the former requires a driving IC (Integrated Circuit) and the latter features the ability to allow a drive circuit to be formed on the substrate.

While the former, the amorphous silicon type, is popular for large liquid crystal displays (simply referred to as "LCD") currently being widely used, the latter, the poly-silicon type, is becoming the mainstream for medium or small liquid crystal displays.

Only poly-silicon type electro-luminescence type (organic EL) displays featuring self-light-emission, thin, lightweight and wide view-angle are being mass-produced.

An organic EL element is generally combined with a TFT and a current is controlled using a voltage/current control action thereof. Here, the voltage/current control action refers to an action of controlling a current between the source and drain by applying a voltage to the gate terminal of the TFT. By so doing, it is possible to adjust light-emitting intensity and display desired gradation.

The use of such a structure, however, causes the light-emitting intensity of the organic EL element to be quite sensitive to being affected by TFT characteristics. In particular, poly-silicon TFT, poly-silicon TFT formed in a low-temperature process called "low-temperature poly-silicon" is above all confirmed to generate relatively large differences in electrical characteristics between adjoining pixels, which constitutes one of the major causes for the deterioration of the display quality of the organic EL display, particularly display uniformity in the screen.

As shown in FIG. 12, the prior art discloses means for correcting a threshold voltage of a poly-silicon TFT 365 which drives an organic EL element.

With an illumination line 340 and auto-zero illumination line 330 set to L levels to turn ON TFT 375 and TFT 370, a select line 320 is set to L level to set a data line 310 to a reference voltage which is higher than a maximum voltage of a data signal. In this way, the gate voltage of a TFT 365 is set to a threshold voltage of the TFT 365. As a result, the difference between a threshold voltage Vth and the reference voltage is charged in a capacitance 350 and the difference between the threshold voltage Vth and supply voltage+Vdd is charged in a capacitance 355.

Next, the illumination line 340 and auto-zero illumination line 330 are set to H level to turn OFF the TFT 375 and TFT 370 and the data signal is set in the data line 340 in this condition. This causes the gate voltage of the TFT 365 to be shifted. This gate voltage corresponds to the threshold voltage of the TFT 365 and this gate voltage can compensate for the threshold voltage of the TFT 365 for each pixel.

Then, the illumination line 340 is set to L level to turn ON the TFT 375, a current corresponding to the gate voltage to which the TFT 365 is set is supplied to an OLED 380 and the OLED 380 emits light. Furthermore, even after the select line 320 is set to H level, the gate voltage of the TFT 365 is kept to the same voltage and the current corresponding to the data signal flows into the OLED 380.

That is, in the prior art shown in FIG. 12, a potential Vg applied to the gate terminal of the TFT 365 is expressed by $Vg=Vth+Vd*Cc/(Cc+Cs)$, where Vth is the threshold voltage of the TFT 365, Vd is a gradation voltage and Cc, Cs are capacitance values shown in FIG. 12. Thus, since the threshold voltage Vth of the TFT 365 of each pixel is always added to Vg, it is possible to give an offset to Vg without changing the gradation voltage Vd even if Vth differs from one pixel to another.

SUMMARY OF THE INVENTION

In the circuit in FIG. 12, the data line can be driven using the signal from the shift register, but it is expected to realize a higher definition display on the basis of such a driving method.

The present invention is an active matrix type display device comprising an active matrix type display array made up of pixel circuits arranged in a matrix form, each pixel circuit made up of a current-driven diode type light-emitting element and a thin-film transistor for controlling the diode type light-emitting element, a data line provided for each column of the matrix for supplying a data signal to the pixel circuits on the corresponding column, a data driver for controlling the supply of the data signal to the data line, a gate line provided for each row of the matrix for supplying a selection signal to pixel circuits on the corresponding row, a gate driver for supplying a selection signal to the gate line and a control circuit for controlling the data driver and gate driver, wherein the data driver switches a plurality of sets of video signals alternately and supplies the video signals to the data line.

In the present invention, the data driver preferably further switches between the plurality of sets of video signals at least for each frame or each line and supplies the video signals to the data line. According to one embodiment of the present invention, the plurality of sets of video signals include a first set and second set, in the data driver, for an odd frame, the first data line on an odd line supplies the first set video signals, the second data line of the same color adjoining the first data line supplies the second set video signals, the first data line on an even line supplies the second set video signals and the second data line supplies the first set video signals, and for an even frame, the first data line on an odd line supplies the second set video signals, the second data line supplies the first set video signals, the first data line on an even line supplies the first set video signals and the second data line supplies the second set video signals.

The present invention provides a plurality of video signals and drives data lines by switching between the plurality of video signals alternately, and can thereby realize a high definition display. Furthermore, the invention switches and drives the video signals alternately, and can thereby suppress flickering as well.

BRIEF DESCRIPTION OF THE DRAWINGS

FIG. 8 is an operation table showing operations of pixel circuits on each row;

DESCRIPTION OF THE PREFERRED EMBODIMENTS

With reference now to the attached drawings, embodiments of the present invention will be explained in detail below.

Embodiment 1

Figure 1:
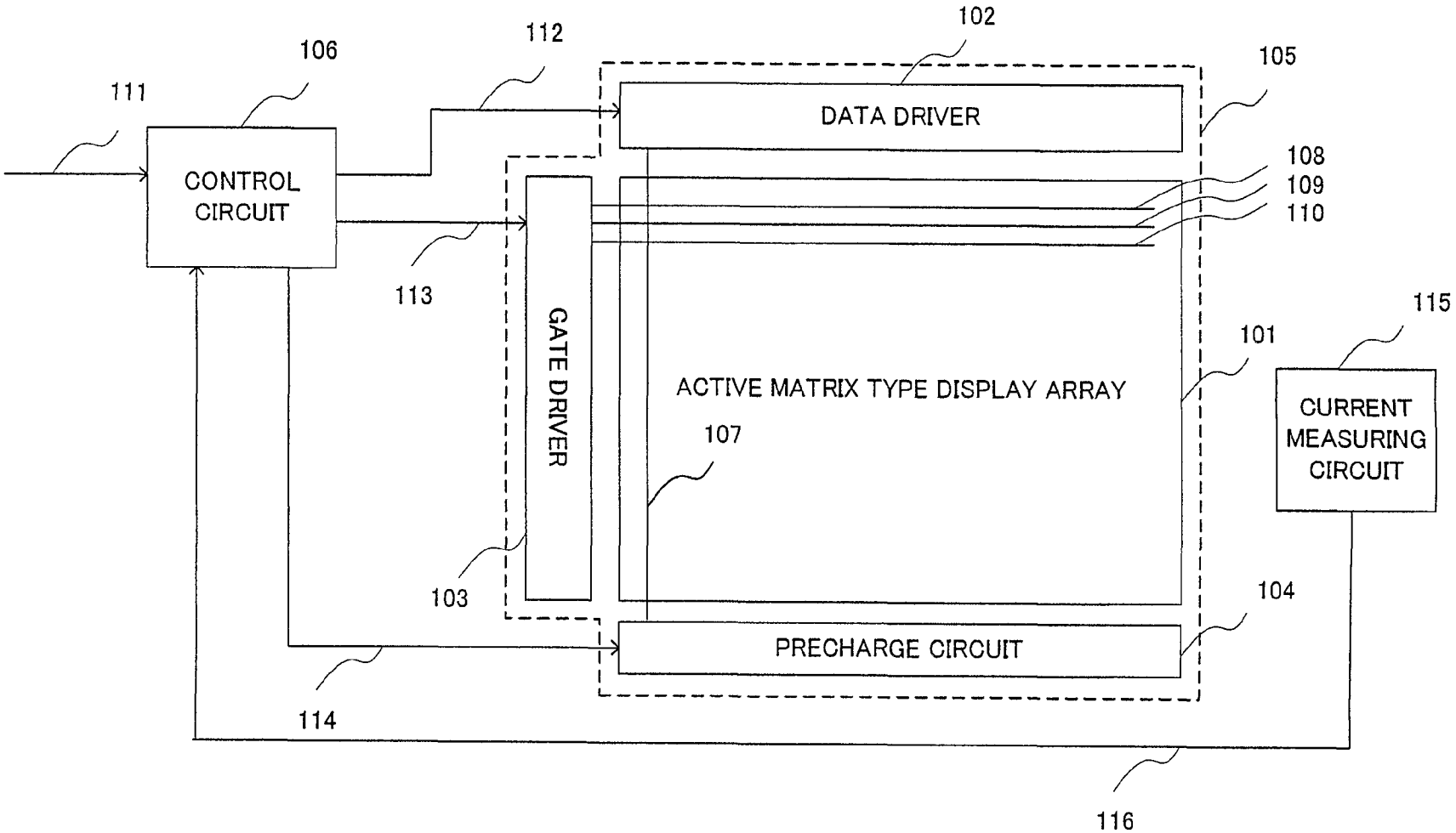
FIG. 1 is an overall block diagram according to Embodiment 1.

FIG. 1 is an overall block diagram of an organic EL display according to this embodiment. Reference numeral 101 denotes an active matrix type display array with organic EL elements and TFTs arranged on pixels arranged in a matrix form, 102 denotes a data driver, 103 denotes a gate driver (selection driver) and 104 denotes a precharge circuit.

Reference numeral 107 denotes a data line which supplies a data potential from the data driver 102 or a precharge potential from the precharge circuit 104 to pixels, 108 denotes a gate line (selection line) which supplies a gate selection potential from the gate driver, and 109, 110 respectively denote a first reset line and a second reset line which supply reset potentials from the gate driver.

If, for example, a low-temperature poly-silicon process is applied, these circuits can be constructed on a glass substrate and a display device 105 can be formed.

Reference numeral 106 denotes a control circuit which supplies an analog video signal and a control signal to the data driver 102 through a data control bus 112 and supplies a control signal to the gate driver 103 through a gate control bus 113.

Reference numeral 115 denotes a current measuring circuit which detects an amount of current which flows into the active matrix type display array 101, varying depending on the magnitude of light-emitting brightness, and which sends the amount of current to the control circuit 106 through a signal line 116. This current measuring circuit 115 measures all currents flowing into the active matrix type display array 101 and the current measuring circuit 115 can be an ammeter disposed between the active matrix type display array 101 and a power supply or an ammeter disposed between the active matrix type display array 101 and ground.

The operation of such an organic EL display will be explained briefly. The data driver 102 selects one data line 107 for one horizontal period and supplies a data potential for a second-half period of one horizontal period. On the other hand, the precharge circuit 104 selects the same data line 107 as that of the data driver 102 and supplies a preset potential for the first-half period of one horizontal period.

Furthermore, the gate driver 103 selects one gate line 108 every one horizontal period sequentially and supplies a reset signal to the corresponding first reset line 109 and the second reset line 110. This causes a data writing operation to be performed for the pixel circuits on the corresponding row after a reset operation.

Furthermore, in this embodiment, it is possible to set a row on which only reset is performed not on a row on which the above described data write is performed. That is, the gate line 108 on another row can also be selected only when the preset potential for the first-half period is supplied, simultaneously with the above described row. Therefore, such a selection of another row allows the pixel circuits on the corresponding row to be only reset. Therefore, setting a period after the above described data write is performed until reset is performed allows the display period to be set arbitrarily. The operation will be explained more specifically later.

The structure of the pixel circuit of the present invention arranged in a matrix form in the active matrix type display array 101 will be explained using FIG. 2.

Reference numeral 201 denotes an organic EL element, 202 denotes a drive TFT which drives the organic EL element 201, 203 denotes a reset TFT which short-circuits the gate and the drain of the drive TFT 202 and converts the drive TFT 202 into a diode and 204 denotes a drive control TFT which turns OFF the current which flows into the organic EL 201.

Reference numeral 205 denotes a selection TFT which supplies and controls a data potential from the data line 107 into a pixel, 206 denotes a storage capacitance which stores a data potential of the data line 107 and 207 denotes a reset capacitance which stores a reset potential.

Reference numeral 211 denotes a power line which supplies a current to the organic EL element 201 and 212 denotes a fixed potential line which fixes the potential of one terminal of the storage capacitance.

The source terminal of the drive TFT 202 is connected to the power line 211, the drain terminal is connected to the source terminal of the drive control TFT 204 and the source terminal of the reset TFT 203, and the gate terminal is connected to one terminal of the reset capacitance 207 and the drain terminal of the reset TFT 203.

The gate terminal of the reset TFT 203 is connected to the first reset line 109, the gate terminal of the drive control TFT 204 is connected to the second reset line 110 and the drain terminal of the drive control TFT 204 is connected to the anode of the organic EL element 201.

The gate terminal of the selection TFT 205 is connected to the gate line 108, the drain terminal is connected to the data line 107 and the source terminal is connected to one terminal of the storage capacitance 206 and one terminal of the reset capacitance 207.

The selection TFT 205, drive TFT 202, reset TFT 203 and drive control TFT 204 are all p-channel TFTs. However, these TFTs 205, 203, 204 may also have n channels.

In such a pixel circuit, the gate line 108 and first reset line 109 are set to L level and the second reset line 110 is shifted from L level to H level first. This causes the selection TFT 205 to turn ON, causes the reset TFT 203 to turn ON and causes the drive control TFT 204 to shift from ON to OFF. Furthermore, the voltage of the data line 107 is set to a precharge potential. Therefore, the drive TFT 202 is diode-connected and a current flows from the power line 211 to the organic EL 201 through the current drive TFT 202 and drive control TFT 204, and then the drive control TFT 204 turns OFF. When the reset TFT 203 turns ON and the drive TFT 202 is diode-connected, the gate voltage of the drive TFT 202 is set to a voltage lower than the voltage of the power line 211 by a threshold voltage of the drive TFT 202. On the other hand, the other end of the reset capacitance 207 is set to a precharge potential and a voltage corresponding to the difference between the two is charged in the reset capacitance 207. The difference between the fixed potential of the fixed potential line 212 and the precharge potential is charged in the storage capacitance 206.

Next, the reset lines 109, 110 are set to H level, the reset TFT 203 and drive control TFT 204 are turned OFF, and then a data potential is supplied to the data line 107. In this way, the potential of the reset capacitance 207 on the gate TFT 205 side is set to the data potential and a voltage corresponding to the difference between the data potential and fixed potential is charged in the storage capacitance 206 and this voltage is stored in the storage capacitance 206. On the other hand, the gate voltage of the drive TFT 202 is shifted by the difference between the precharge potential and data potential. For example, if the gate voltage is Vg, the precharge voltage is Vpr, the data voltage is VD, the voltage of the power line 211 is VDD and the threshold voltage of the drive TFT 24 is Vth, then Vg=Vth−(Vpr−VD).

Thus, since the gate voltage of the drive TFT 202 can be set to a voltage according to the threshold voltage of the drive TFT 202 and data potential, the drive control transistor 204 is turned ON with the second reset line set to L level and when one horizontal period ends, the gate TFT 205 is turned OFF with the gate line 108 set to H level. In this way, the drive TFT 202 is driven by the gate voltage which has been set as described above, the drive current is supplied to the organic EL 201 and the organic EL 201 emits light driven by the drive current which compensates for the threshold voltage of the drive TFT 202.

The structures of the data driver 102 and precharge circuit 104 will be explained using FIG. 3.

Figure 3:
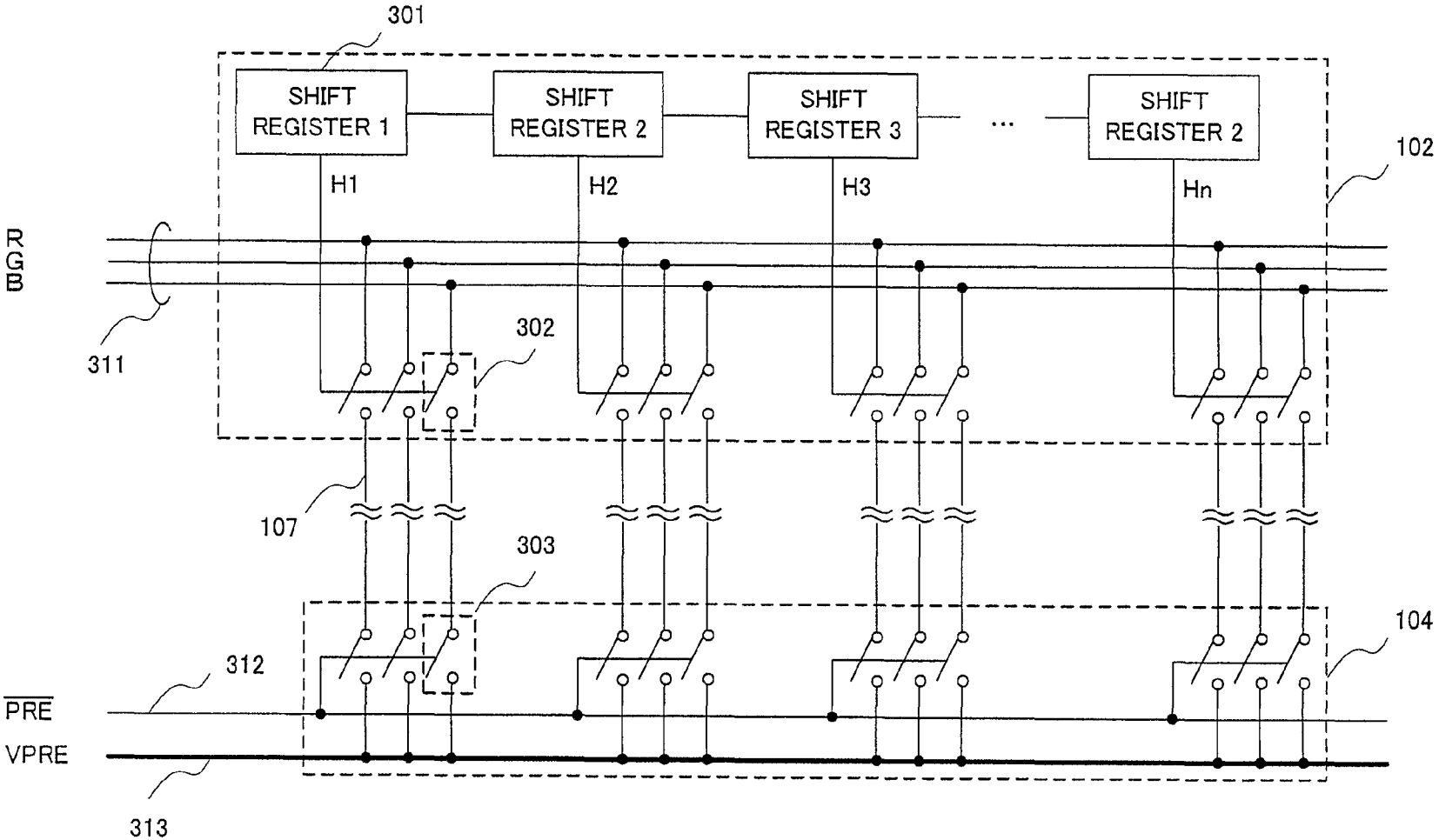
FIG. 3 illustrates a data driver and a precharge circuit according to Embodiment 1.

Reference numeral 301 denotes a shift register, 302 denotes a video switch, 311 denotes video signal lines and the data driver 102 in FIG. 3 shows a data driver structure corresponding to one set of RGB.

The shift register 301 shifts an input pulse (e.g., one H level) sequentially from the shift register 1 to n in synchronization with a predetermined clock. A pulse resulting from shifting the input pulse to the shift register 1 to n is output to an output terminal Hi (i=1 to n), the video switch 302 is controlled (turned ON sequentially) by this pulse, and the corresponding video signal is output to the corresponding data line 107 and sampled-and-held.

Furthermore, the precharge circuit 104 is constructed of a precharge switch 303, a precharge control line 312 and a precharge line 313, and it is possible to charge the precharge potential supplied to the precharge line 313 into the data lines 107 through a single line in a collective manner by controlling the precharge control line 312.

That is, an input pulse is shifted sequentially from the shift register 1 to n for one horizontal period and video signals from the three video signal lines of RGB are supplied to the data lines 107 sequentially corresponding to the second-half period of one horizontal line. In this example, there are R (red), G (green) and B (blue) pixels each forming one column and data is written in these columns of pixels in parallel. This data write is performed for the second-half period of one horizontal period. On the other hand, a precharge potential is written on these data lines 107 for the first-half period of the horizontal period.

For this reason, the precharge potential is supplied first and then the data potential is supplied to pixels on the selected horizontal line. On other horizontal lines, only the precharge potential is written (reset), which will be explained later.

The structure of the gate driver 103 will be explained using FIG. 4.

Reference numeral 401 denotes a shift register, 402 denotes a gate enable circuit, 403 denotes a first reset enable circuit, 404 denotes a second reset enable circuit, 405 denotes a gate buffer, 406 denotes a first reset buffer and 407 denotes a second reset buffer.

E1, E2 are gate enable control lines for odd lines and even lines, respectively, and R1, R2 are a first reset control line and a second reset control line, respectively.

The gate enable circuits of odd lines are connected to the gate enable control line E1 and the gate enable circuits of even lines are connected to the gate enable control line E2. The first reset enable circuits of all lines are connected to the first reset control line R1 and the second reset enable circuits of all lines are connected to the second reset control line R2.

Furthermore, the enable circuits 402, 403, 404 of each line are connected to each shift register output Vi (i=0 to n) and the shift register output Vi and E1, E2, R1, R2 control the gate line, first and second reset lines.

The enable circuits 402, 403, 404 are AND gates and output H level only when both input signals are H level. Therefore, the enable circuit 402 to which Vi on an odd row is input outputs E1 when the corresponding Vi is at H level and this E1 is inverted at the gate buffer 405 and output to the gate line 108. Therefore, the selection TFT 205 of the pixel circuit is turned ON over a period during which the gate enable control signal E1 is at H level. On the other hand, the enable circuit 403 outputs R1 when Vi is at H level, this R1 is inverted at the first reset buffer 406 and supplied to the first reset line 109. Therefore, the first reset line 109 becomes L level over a period during which the first reset control signal R1 is at H level and the reset TFT 203 is turned ON. Furthermore, the enable circuit 404 outputs R2 when Vi is at H level and this R2 is supplied from the second reset buffer 407 to the second reset line 110 with the same polarity. Therefore, for the period during which the corresponding Vi is at H level, the first reset line 109 becomes L level over a period during which the second reset control signal R2 is at H level and the drive control TFT 203 turns ON. Furthermore, the second reset line 110 becomes L level over a period during which the corresponding Vi is at L level and the drive control TFT 204 turns ON.

The driving method in this embodiment will be explained using FIG. 5.

Figure 5:
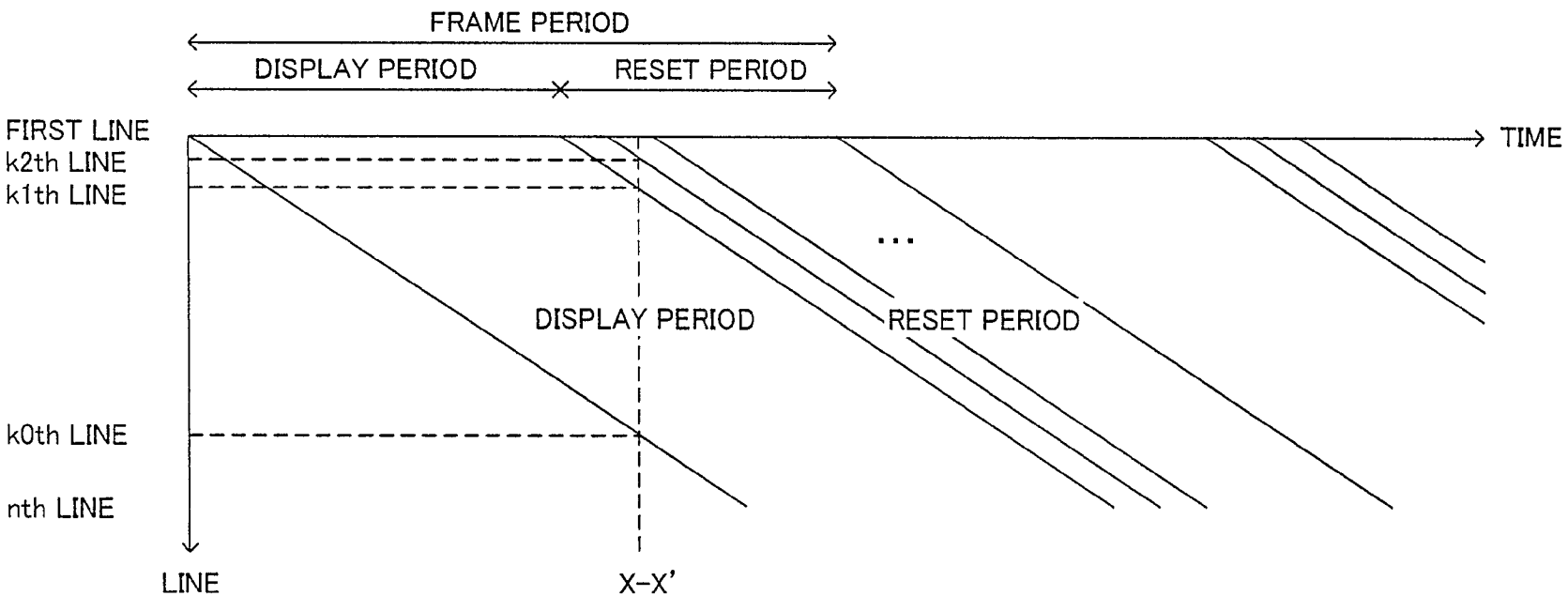
FIG. 5 illustrates a drive sequence.

FIG. 5 shows time on the horizontal axis and a line on the vertical axis to illustrate the display status of a frame period. Thus, one-frame period on each line (horizontal scanning line) is divided into a display period during which video data is displayed and a reset period during which the drive TFT is reset. That is, the reset period of a certain duration is allocated after the display period of the certain duration.

First, video data is sequentially written starting from the first line and lines whose writing has been completed move on to the display period. Then, before writing of video data on all lines is completed after a predetermined period, the pixels on the horizontal line which have already passed the current corresponding to the video data are reset, the display period is closed and the reset period starts. In this embodiment, reset of pixels, that is, reset of the drive TFTs of their respective pixels, is performed sequentially at a plurality of different times.

In FIG. 5, when focused on a segment X-X', video data is written on the k0th line, and the k1th line and the k2th line are reset.

For example, suppose there are 480 horizontal lines in the vertical scanning direction, k0 is the 11th line and the ratios of the display period and reset period are both 50%. In this case, Vk0=V11 becomes H level for the 11th horizontal scanning period. In this way, reset and data write are performed on the pixels on the 11th horizontal line and the display period starts from the next 12th horizontal scanning period. The display period is 240 horizontal scanning periods and Vk0=V11 becomes H level for the 252nd horizontal scanning period. In this 252nd horizontal scanning period, reset and data write are performed on the 252nd line, but only reset is performed on the pixels on the 11th line. Therefore, the display of the pixels on the 11th line is finished by this reset and a reset period starts. Then, by setting V11 to H level for an arbitrary even horizontal scanning period (k1th line) between the 254th horizontal scanning period to the 10th horizontal scanning period in the next frame, reset is performed once during the reset period. It is preferable to further increase the number of times reset is performed during this reset period.

Using FIG. 6, FIG. 7 and FIG. 8, the control steps of the data driver 102, gate driver 103 and precharge circuit 104 shown in FIG. 5 will be explained in detail.

Figure 6:
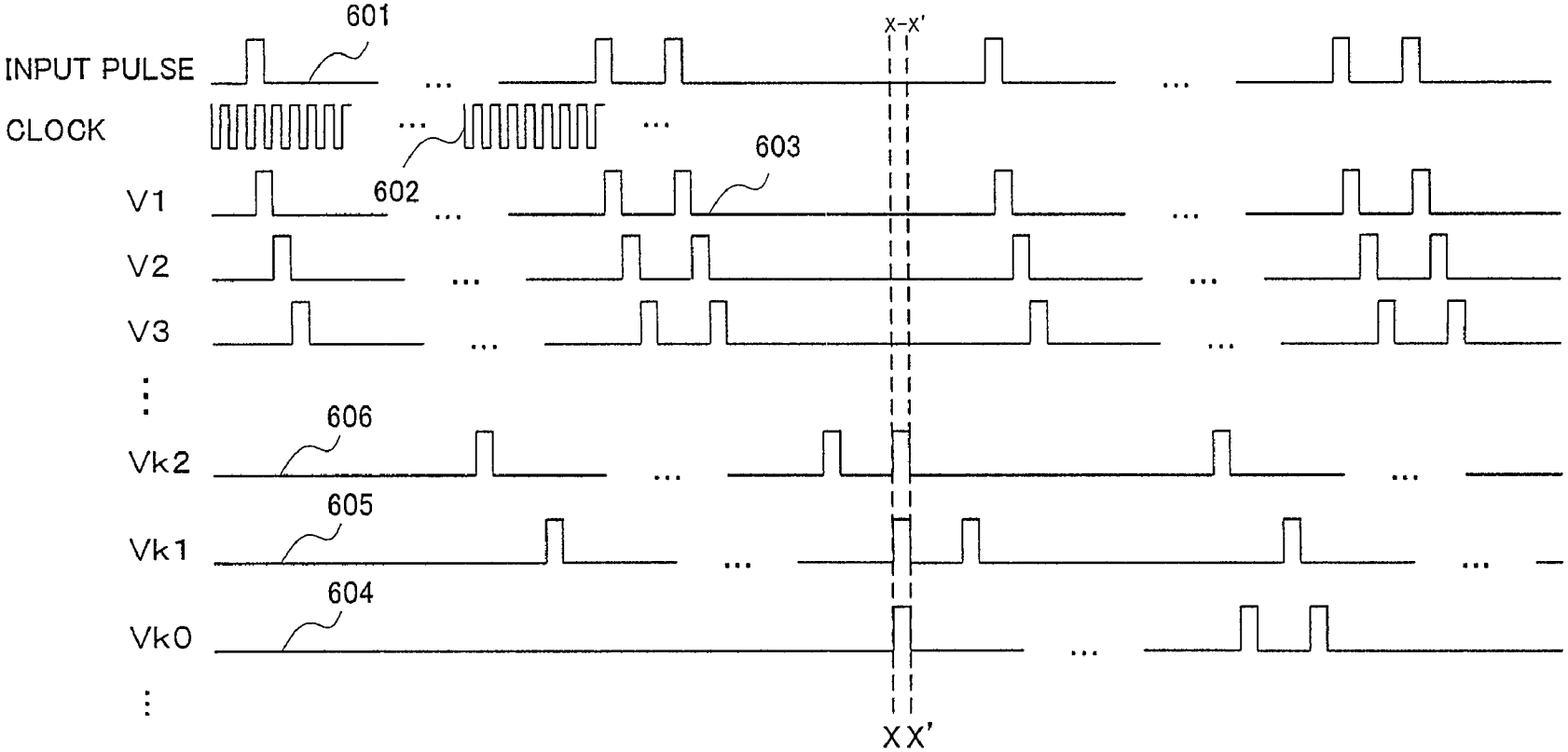
FIG. 6 is a panel drive timing chart.

In FIG. 6, reference numeral 601 denotes an input pulse which is input to the shift register of the gate driver 103, 602 denotes a clock for shifting the input pulse 601, 603 denotes a shift pulse of the shift register output Vi and this pulse is shifted sequentially in the vertical scanning direction and output to Vi. The period of this clock 602 corresponds to the horizontal scanning period.

Reference numeral 604 denotes the shift register output pulse of the k0th line, 605 denotes the shift register output pulse of the k1st line, 606 denotes the shift register output pulse of the k2nd line and both are active during the X-X' segment. As described above, all output pulses 604, 605 and 606 are pulses for starting a display period during which the first pulse in the figure performs reset or data write, the second pulse is a pulse for starting a reset period during which only reset is performed and the third pulse is a pulse for resetting again during a reset period.

Figure 7:
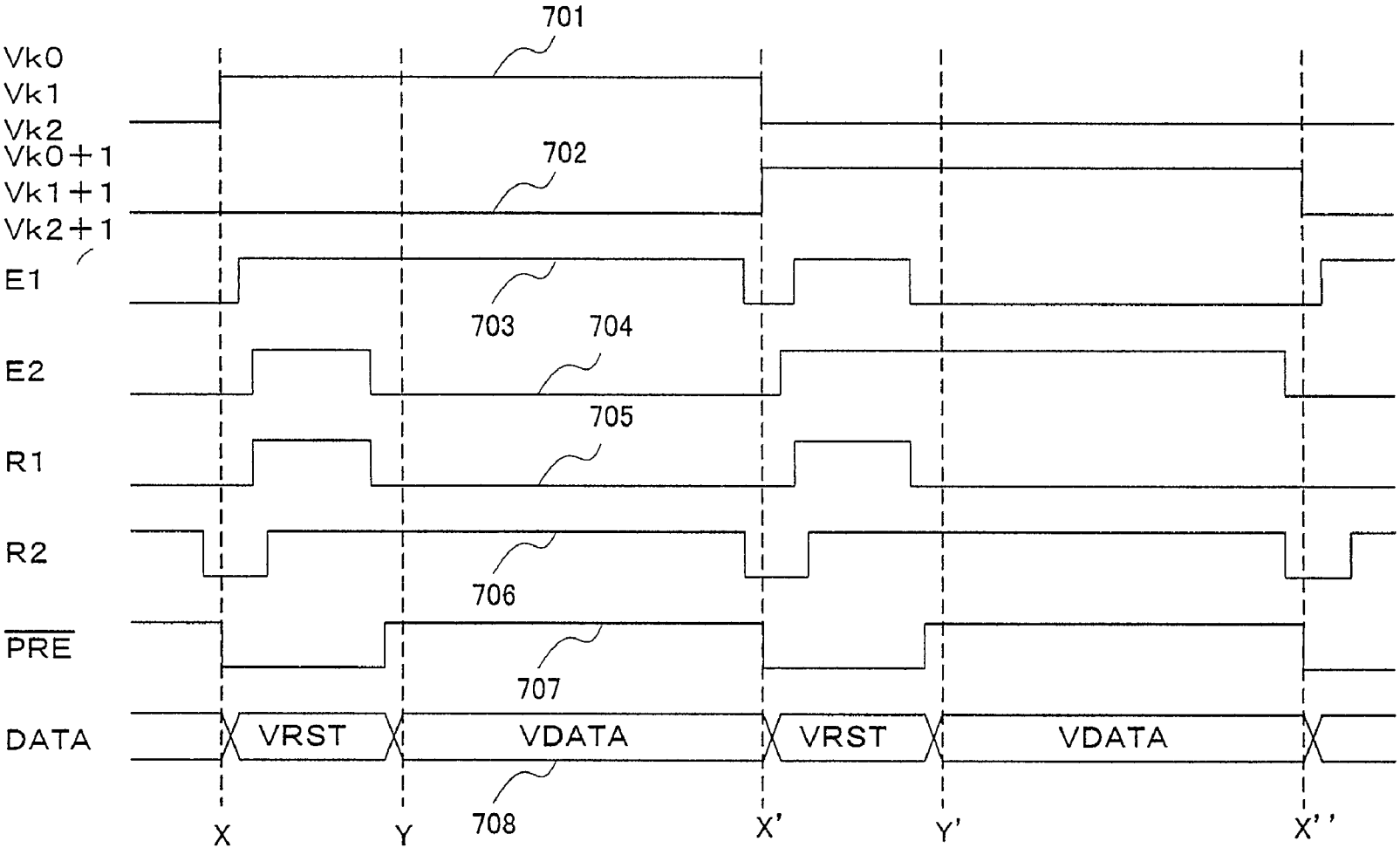
FIG. 7 is an enlarged view of the panel drive timing chart.

In FIG. 7, reference numeral 701 denotes an output pulse of the shift register outputs Vk0, Vk1, Vk2 in the X-X' segment, 702 denotes an output pulse of the shift register outputs Vk0+1, Vk1+1, Vk2+1 in the same segment, 703 denotes the enable control line E1 for odd lines, 704 denotes the enable control line E2 for even lines, 705 denotes the first reset control line R1, 706 denotes the second reset control line R2, 707 denotes the precharge control line and 708 denotes the data potential of the data line 107.

Figure 2:
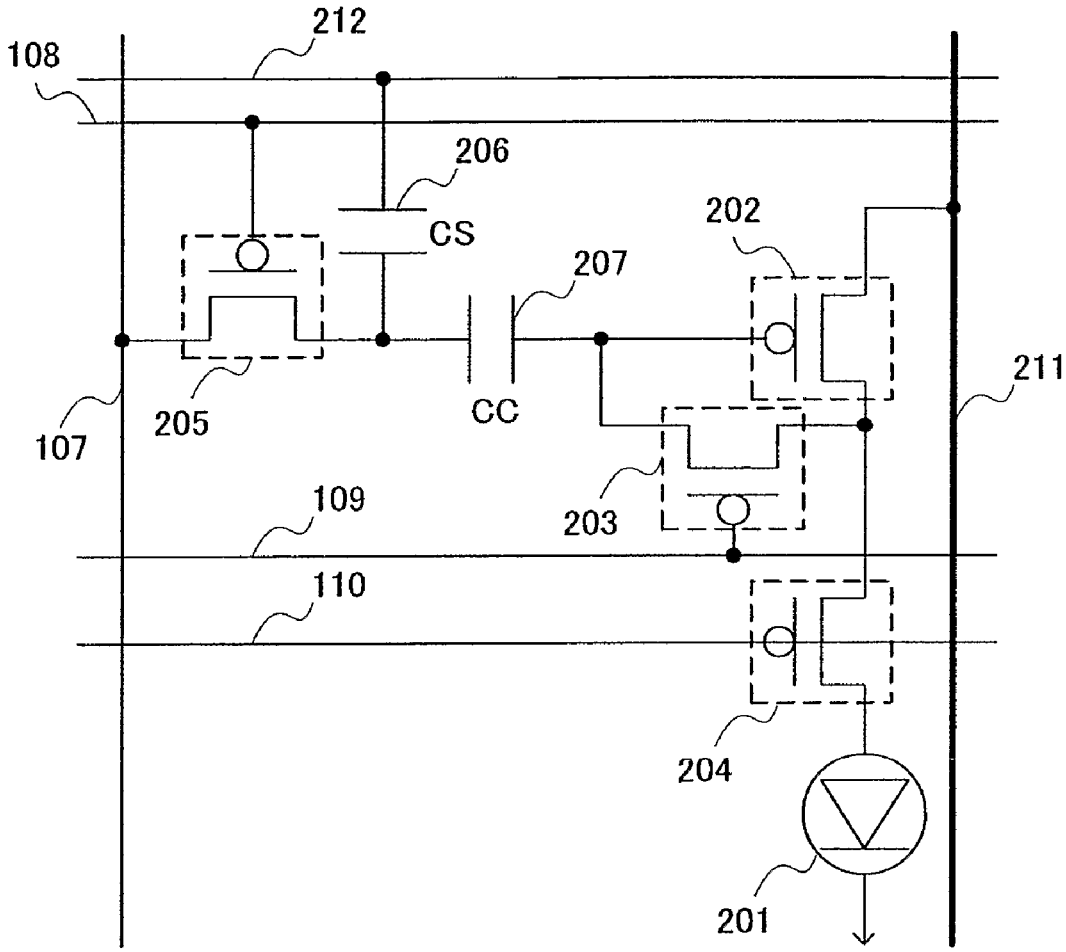
FIG. 2 illustrates a structure of a pixel circuit.

FIG. 8 is an operation table of the pixel circuit in FIG. 2 and shows operations of pixels corresponding to their respective pulse levels when the data driver 102, gate driver 103 and precharge circuit 104 are constructed as shown in this embodiment.

Operations of pixels in FIG. 7 will be explained based on the operation table in FIG. 8.

In FIG. 7, if the input pulse 601 is input so that k0 becomes an odd number, and k1 and k2 become even numbers, since E1 is at H level, R1 and R2 are at H level and precharge is enabled in an X-Y segment which is the first-half period of the X-X' segment, the k0 line corresponds to a reset period from FIG. 8(1). Furthermore, since E2 is shifted from L level to H level, the k1 and k2 lines also correspond to reset periods from FIG. 8(4).

That is, Vi is at H level on any line of k0, k1 and k2, the gate line 108 and the first reset line 109 are at L level and the second reset line 110 is shifted from L level to H level, and therefore the gate potential of the drive TFT 202 is reset to a threshold voltage Vth.

In the Y-X' segment which is the second-half period of the X-X' segment, E1 and R2 are at H level, R1 is at L level and precharge is disabled, and therefore from FIG. 8(2), data is only written on k0. That is, on k0, E1 is also at H level for Y-X', and so the selection TFT 205 on the k0 line turns ON and the data potential on the data line 107 is charged in the storage capacitance 206. On the other hand, with regard to the k1, k2 lines, since E2 is at L level for Y-X', the corresponding selection TFT 205 turns OFF and the data potential on the data line 107 is not charged in the storage capacitance 206.

Thus, in the X-X' segment, data is written on the k0 line after reset and only reset is performed on the k1, k2 lines.

In an X'-X" segment, data has been written on the k0 line from FIG. 8(3) as described above, the display of the written data is started. On the other hand, since the k1, k2 lines are in a reset state, the reset period is continued.

Furthermore, in an X'-X" segment, the k0+1 line which is an even line and k1+1, k2+1 which are odd lines are in a state of FIG. 8(4) and FIG. 8(1), respectively, for a first-half period X'-Y', and therefore this period is a reset period and data is only written on the k0+1 line for a second-half period Y'-X".

Driving the pixel circuits sequentially in this way makes it possible to provide the display period and reset period for the frame period as shown in FIG. 5.

In this embodiment, reset is performed three times for one-frame period on each line, but when one reset period cannot be secured sufficiently, performing reset many more times is preferable because in this way the reset potential becomes stable.

Figure 13:
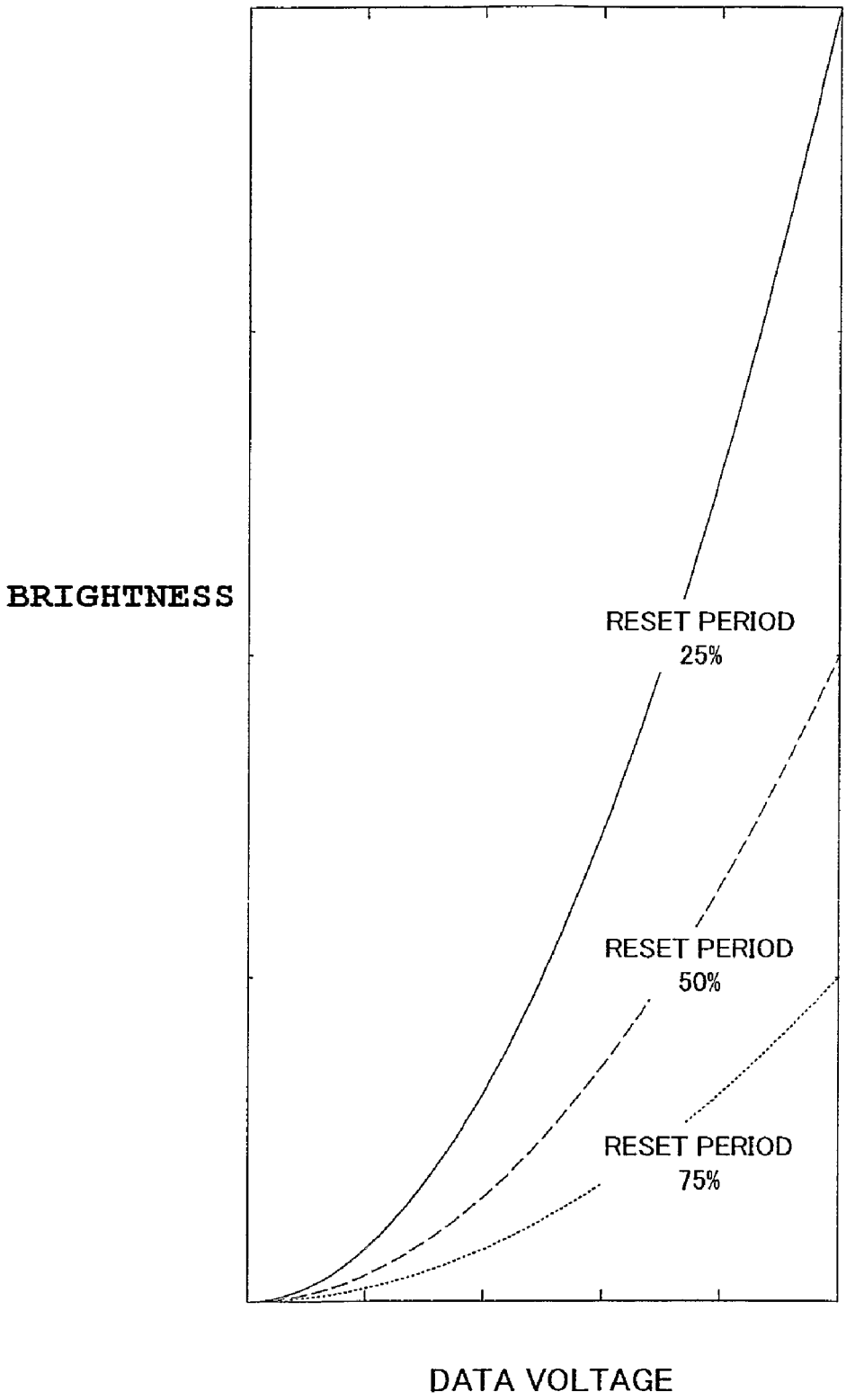
FIG. 13 illustrates a relationship between a reset period and brightness.

Furthermore, by controlling pulse intervals (interval between a pulse for performing reset and data write and the first pulse for performing only reset) of the input pulse 601, it is possible to make the ratio of the display period and reset period variable. FIG. 13 shows a relationship between the data voltage Vd and brightness when the reset period is changed from 25% to 50%, and 75%. When the ratio of the reset period is increased, the display period is shortened, and therefore it is possible to darken the whole while keeping the same gradation characteristic.

Figure 14:
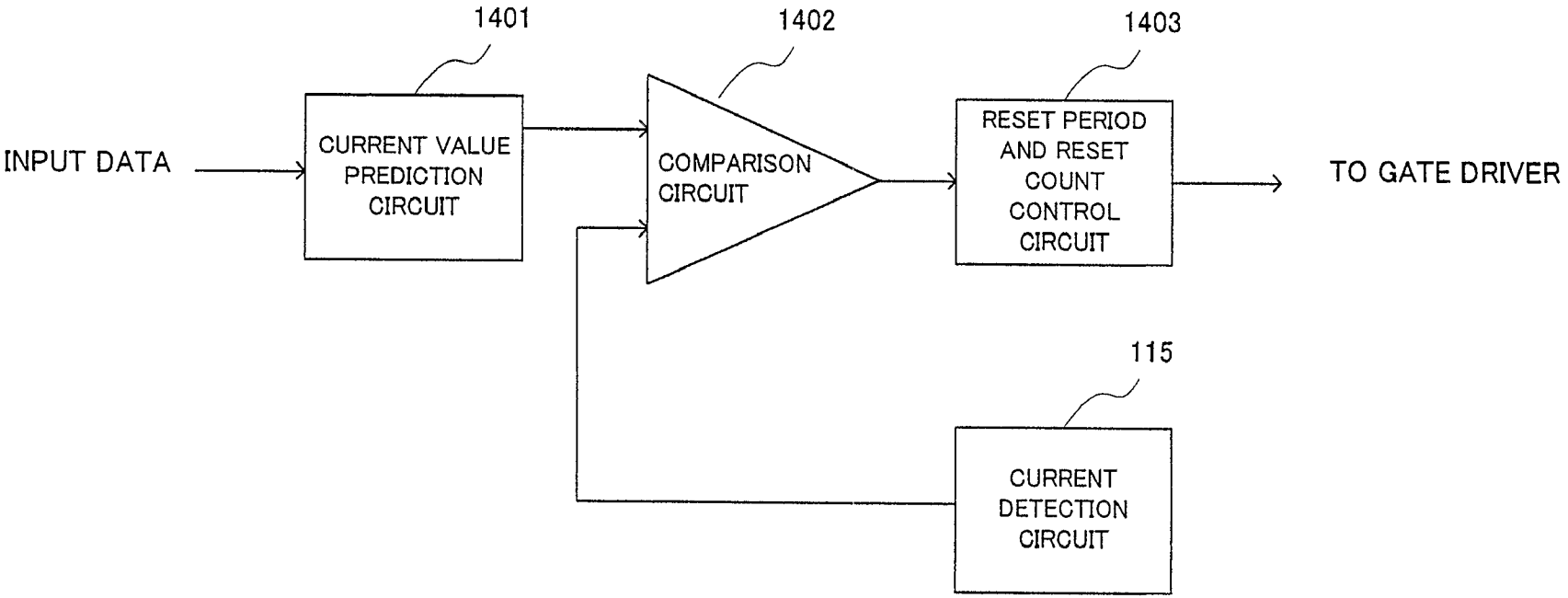
FIG. 14 illustrates a structure of control based on a current measured value.

When these functions are used together with, for example, the current measuring circuit 115, it is possible to compensate for a leakage current of a TFT by outside light as shown in FIG. 14.

In the pixel circuit in FIG. 2, there are two types of influence of the leakage current; one caused by leakage of the selection TFT 204 and the other caused by a variation of the current characteristic of the drive TFT 202. The former releases a reset load which is stored in the storage capacitance 206, and therefore the gradation voltage is changed with the lapse of time. Furthermore, the latter acts so that the current of the drive TFT 204 flows more, and so the black level of the video floats and cannot maintain the display quality. That is, the amount of current at the black level increases, producing a certain degree of brightness.

FIG. 14 illustrates a structure of a leakage current correction system when the display of this embodiment is used under illumination. Reference numeral 1401 denotes a current value prediction circuit, 1402 denotes a comparison circuit and 1403 denotes a reset period and reset count control circuit.

In this system, the total value of currents flowing from the input data to the display array can be predicted, and therefore the current value prediction circuit 1401 predicts the current value first. Then, the comparison circuit 1402 compares the predicted current value with the current value from the current measuring circuit 115 and changes the reset period and reset count according to the difference between the predicted value and detected current value.

The control circuit 1403 increases the reset count and thereby repeats reset and charging many times even if the leakage at the reset TFT 203 increases, and in this way it is possible to complement the reset charge. Furthermore, by increasing the reset period, it is possible to cancel the current increase of the drive TFT 202.

When the comparison circuit 1402 actually detects a current difference, immediately reflecting the current difference on the display would result in flickering, and therefore it is preferable to perform control so that the current difference is provided with hysteresis and the hysteresis is reflected by a Schmitt trigger type.

Furthermore, for these reset periods, the adjusting function on the reset count need not be used for correction of the leakage current. For example, extending the reset period and shortening the display period will reproduce a light-emitting characteristic of a CRT, etc., in a pseudo-form, and can thereby improve viewability of moving images. Thus, by increasing the supply voltage and increasing the current value corresponding in amount to the shortening of the display period, it is possible to use this embodiment for moving image applications such as TV.

Embodiment 2

Figure 9:
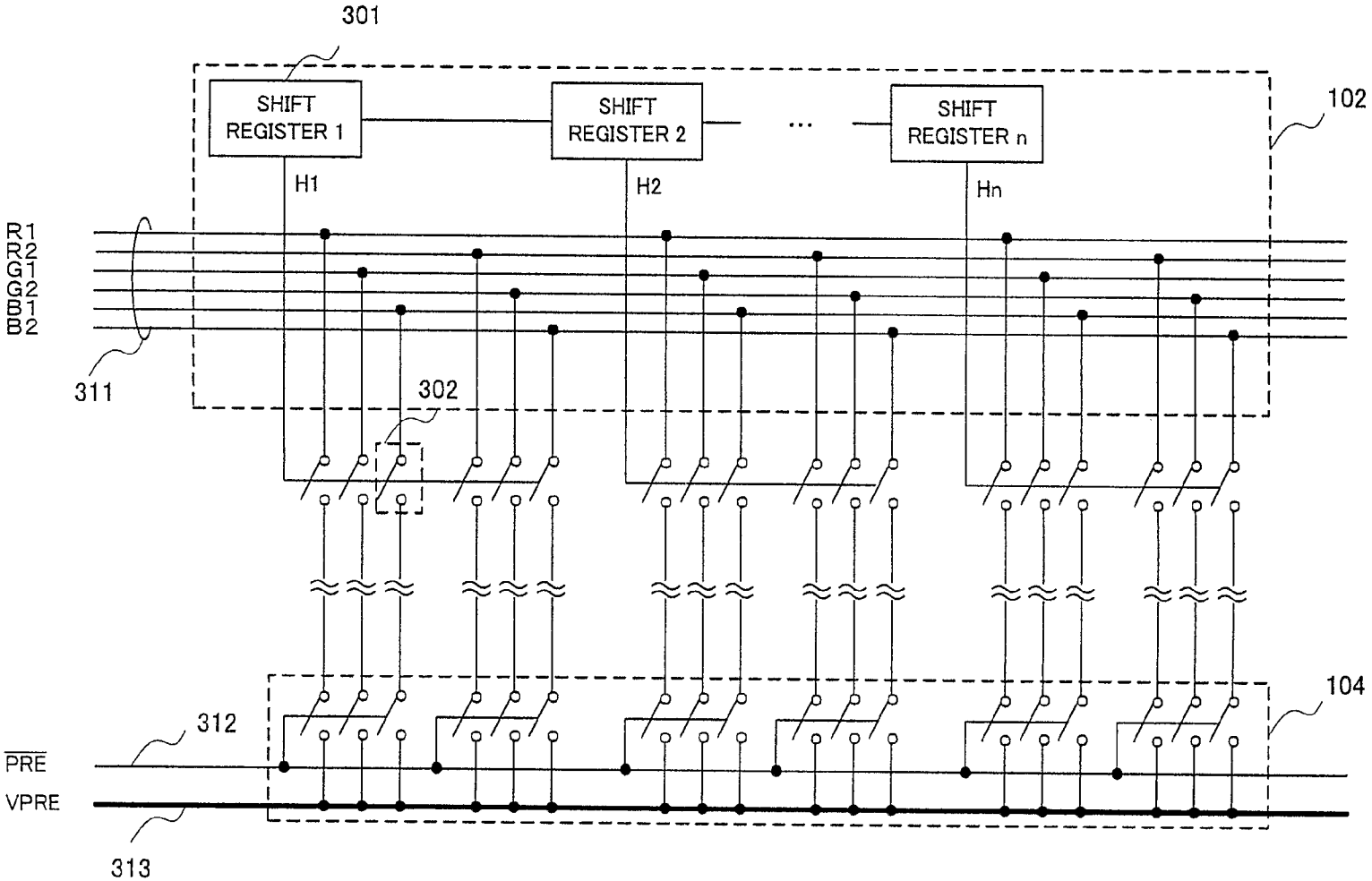
FIG. 9 illustrates a data driver and precharge circuit according to Embodiment 2.

FIG. 9 shows an internal structure of a data driver 102 according to Embodiment 2. FIG. 9 is an example designed to realize a higher definition display, which expands video signal lines 311 to two sets of video signal lines, namely first video signal lines (R1, G1, B1) and second video signal lines (R2, G2, B2). Using a signal Hi (i=1 to n) of one shift register 1 to n, the two sets of video signal lines, three lines each (a total of six lines), are connected to the corresponding data lines 107. Therefore, when attention is focused on a certain data line, either the first video signal or second video signal is supplied thereto. This allows one pulse of a shift register to sample-and-hold video signals corresponding to twice as many pixels, and can thereby drive a panel with higher resolution.

However, if there are two or more sets of video signal lines 311, two or more sets of video circuits for generating analog video signals are required, producing variations in the display of adjoining pixels due to variations of both gains.

Figure 10:
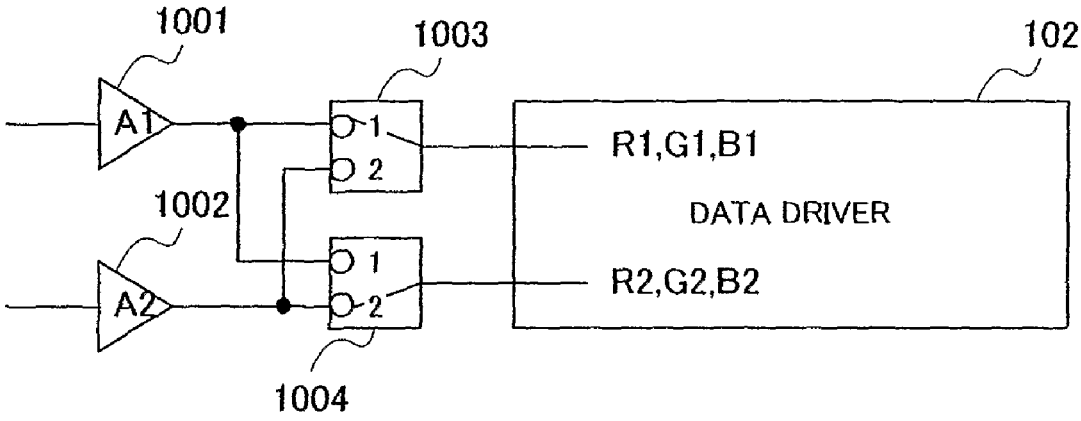
FIG. 10 illustrates a structure of a display variation smoothing circuit.

FIG. 10 is a circuit provided to suppress the display variations, with reference numeral 1001 denoting a first video circuit of the two sets of video circuits, and 1002 denoting a second video circuit. Reference numeral 1003 denotes a first video switch connected to the first video signal line of the two sets of the video signal lines 311 and 1004 denotes a second video switch connected to the second video signal line.

The output of the video circuit 1001 is connected to terminals 1 of the first and second video switches 1003, 1004 and the output of the video circuit 1002 is connected to terminals 2 of the first and second video switches 1003, 1004. Therefore, the first and second video switches 1003, 1004 can select the first video signal and second video signal alternately and select video signals which are different from each other. For example, when attention is focused on the first data line and the second data line of the same color adjoining the first data line, it is possible to select video signals alternately, for example, by supplying the first video signal to the first data line and supplying the second video signal to the second data line.

Figure 11:
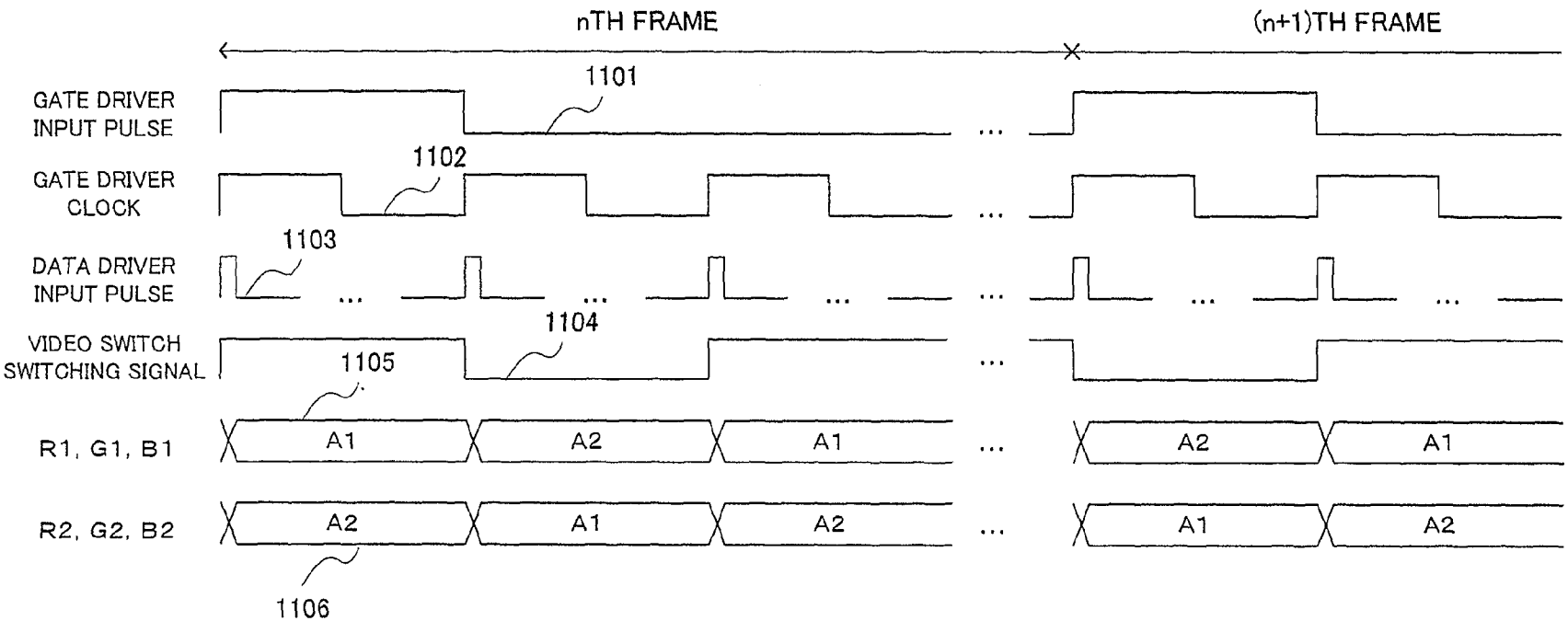
FIG. 11 is a drive timing chart of the display variation smoothing circuit.

FIG. 11 is a switching timing chart of the video switches 1003, 1004. Reference numeral 1101 denotes an input pulse to be input to a shift register 401 of a gate driver 103, 1102 denotes a clock to shift the input pulse 1101, 1103 denotes an input pulse to be input to a shift register 301 of a data driver 102, 1104 denotes a switching signal for switching between the video switches 1103 and 1104, 1105 denotes a video signal on a first video signal line and 1106 denotes a video signal on a second video signal line.

Switching is performed alternately between an odd line and even line, between an odd frame and an even frame at the timing of the switching signal 1104. In this way, signals of the video circuits 1001 and 1002 are alternately written on pixels for every frame, and therefore display variations are smoothed. That is, as shown in FIG. 11, the first video signal and second video signal are supplied alternately such as A1, A2, A1, A2, . . . , on the line on which the nth frame exists, and the first video signal and second video signal are supplied alternately such as A2, A1, A2, A1, . . . , on the next line. Then, in the next (n+1)th frame, the first video signal and second video signal are supplied alternately such as A2, A1, A2, A1, . . . , on a certain line, and the first video signal and second video signal are supplied alternately such as A1, A2, A1, A2, . . . , on the next line.

Furthermore, by also performing switching for every line, it is possible to suppress flickering and prevent display variations from becoming noticeable even if the output characteristics of the video circuits 1001, 1002 differ from each other. Furthermore, this circuit may also be incorporated in the control circuit 106 or formed on a glass substrate.

Embodiment 3

Figure 15:
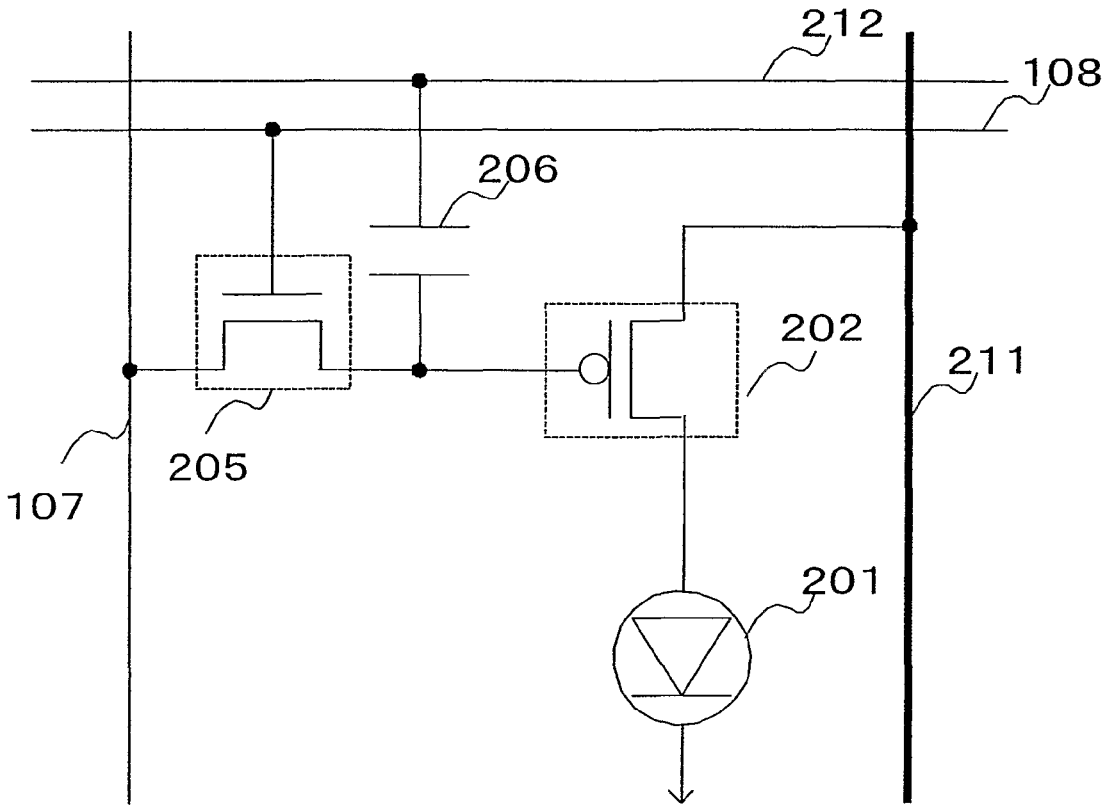
FIG. 15 illustrates another example of the structure of the pixel circuit.

FIG. 15 is a conventionally known pixel circuit, which includes two TFTs, namely a selection TFT 205 and a drive TFT 202, and one storage capacitance 206 in addition to an organic EL element 201. The source of the selection TFT 205 is connected to a data line 107, the drain is connected to the gate of the drive TFT 202 and the gate is connected to a gate line 108. Furthermore, a non-fixed potential end of the storage capacitance 206 whose other end is connected to a fixed potential line 212 is connected to the gate of the drive TFT 202. The source of the drive TFT 202 is connected to a power line 211 and the drain is connected to the anode of the organic EL element 201. The cathode of the organic EL element 201 is connected to a cathode power supply.

In this circuit, too, as with the above described embodiment, a precharge voltage is supplied to the data line 107 for a first-half period of one horizontal period and data is written only on a horizontal scanning line on which data is written for a second-half period.

Figure 4:
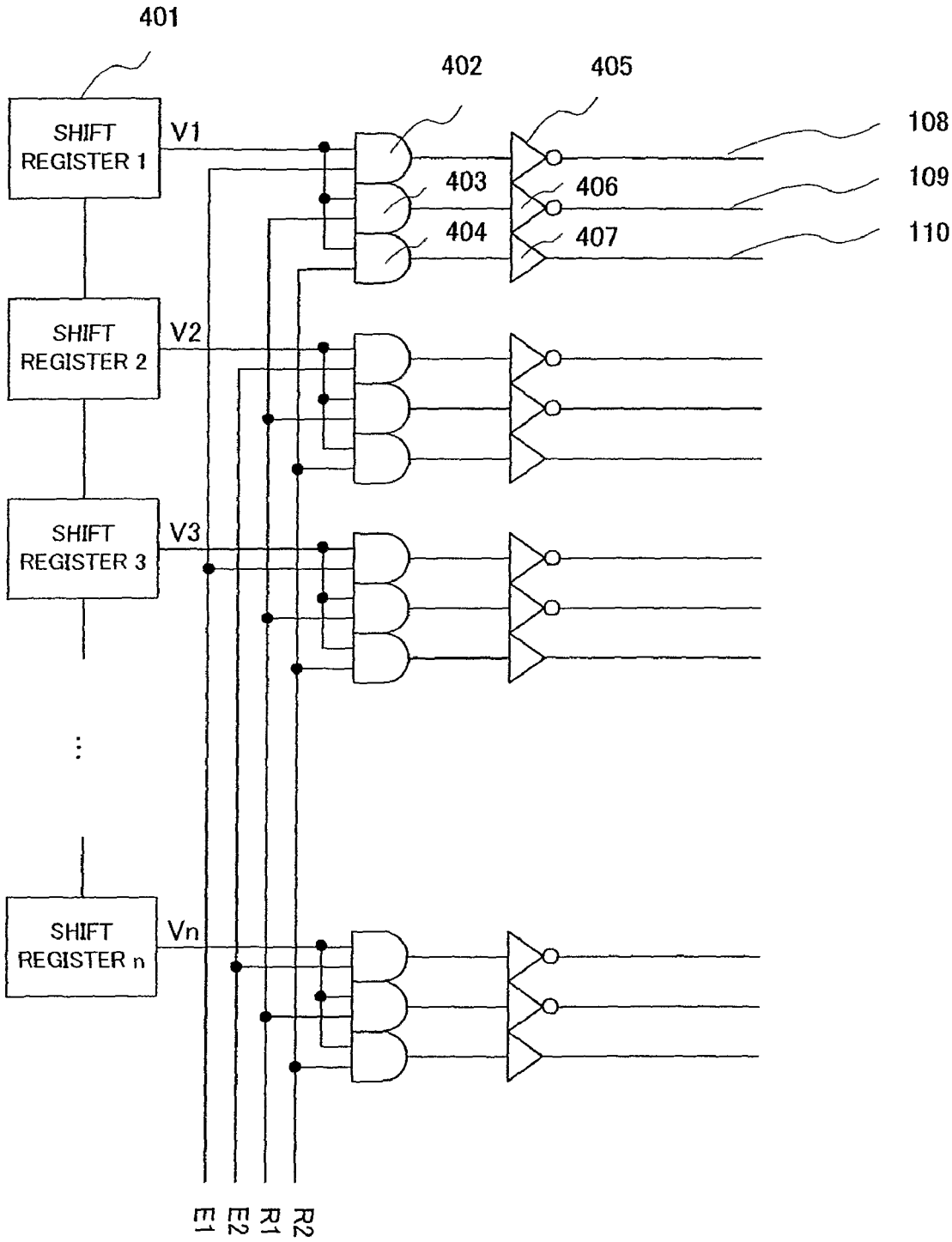
FIG. 4 is a block diagram of a gate driver.

In this embodiment, there is no reset line, and therefore the enable circuits 403, 404 in FIG. 4 are not necessary and only the enable circuit 402 should be provided. Furthermore, the R1, R2 in FIG. 7 are not necessary either.

When such a circuit is used, it is also possible to make a reset time variable as in the case of the above described embodiment.

Figure 12:
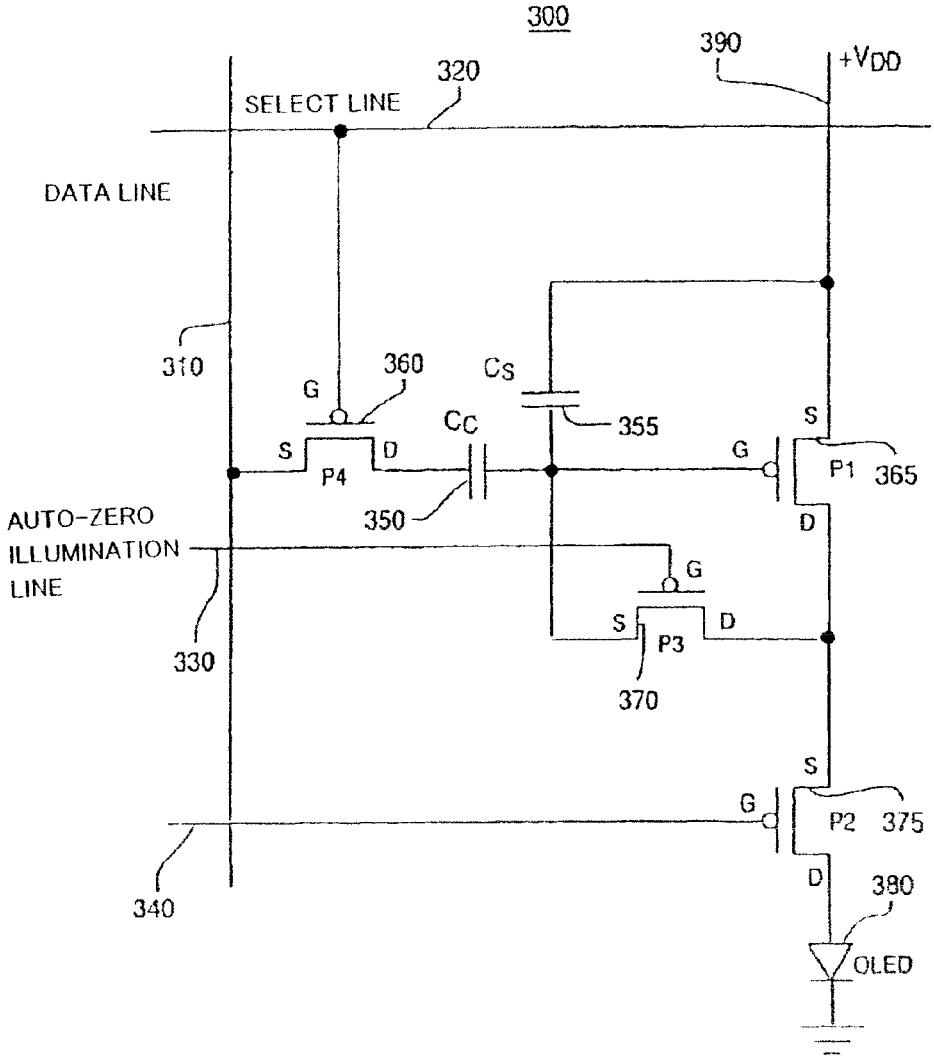
FIG. 12 illustrates a pixel circuit of a conventional example.

The reset operation of the present invention is not limited to the pixel circuits in FIG. 2 and FIG. 15, but may also be applied to various pixel circuits such as the pixel circuit described in FIG. 12 or pixels of opposed electrodes between which a liquid crystal, etc., is sandwiched.

Figure 16:
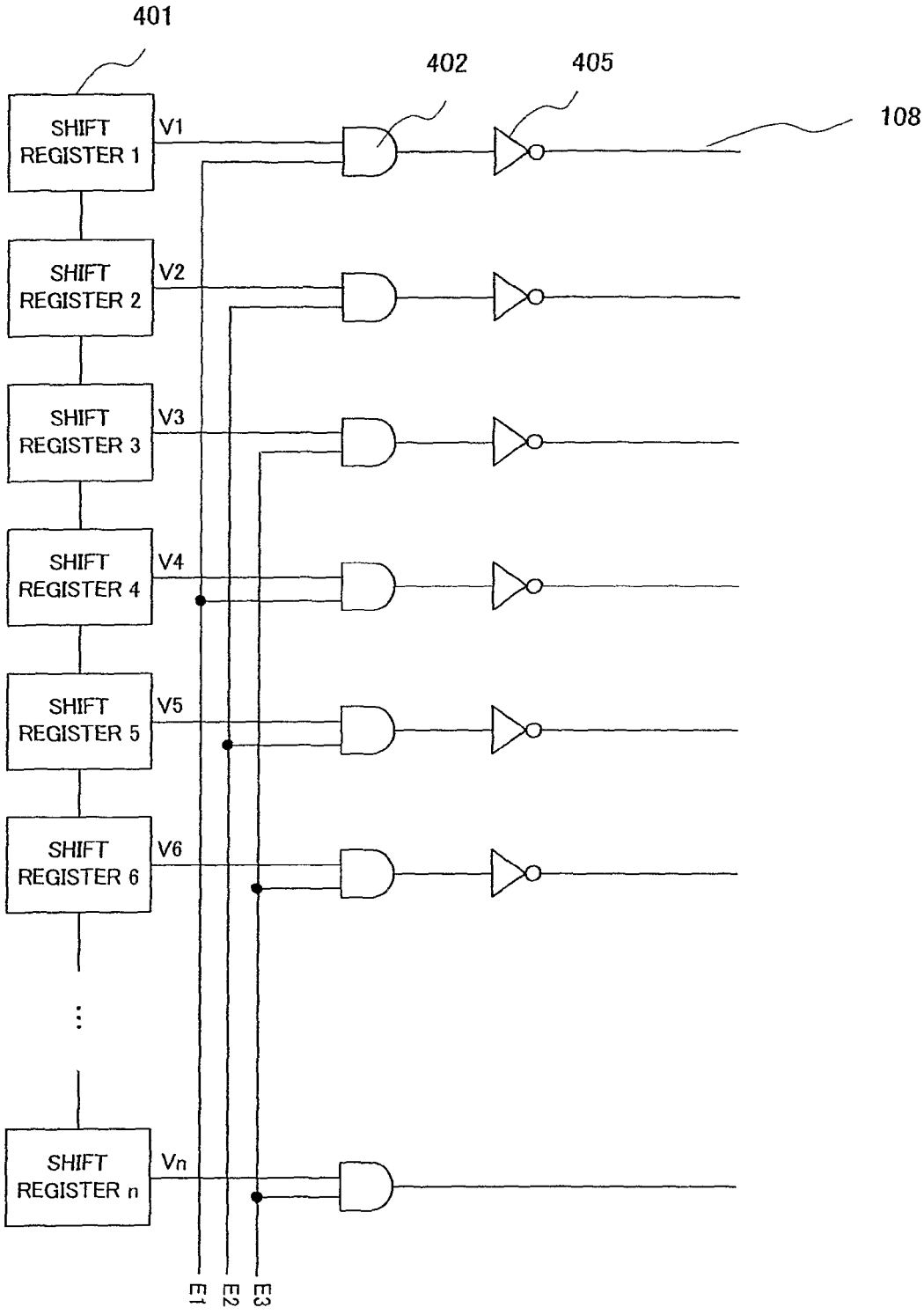
FIG. 16 illustrates another example of the structure of the gate driver.

Furthermore, the structure of the gate driver is not limited to the one shown in FIG. 4. For example, as shown in FIG. 16, it is also possible to use three or more enable control lines. That is, in the case of the structure in FIG. 16 using three enable control lines, an enable circuit 402 is connected to any identical enable control line of the three enable control lines E1, E2, E3 on every third line, one of the three enable control lines may be selected for video writing and at least the remaining one may be selected for reset writing. Using such a gate driver, the same reset operation as that described above can also be realized.

PARTS LIST

E1 gate enable control line
E2 gate enable control line
E3 gate enable control line
R1 first reset control line
R2 second reset control line
101 active matrix type display
102 data driver
103 gate driver (selection driver)
104 precharge circuit
105 display device
106 control circuit
107 data line
108 gate line (selection line)
109 first reset line
110 first reset line
112 control bus
113 control bus
115 current measuring circuit
201 organic EL element
202 drive TFT
203 reset TFT
204 drive control TFT
205 selection TFT
206 storage capacitance
207 reset capacitance
211 power line
212 fixed potential line
301 shift register
302 video switch
310 data line
311 video signal line
311 video signal lines
312 precharge control line
313 precharge line
320 select line
330 auto-zero illumination line
340 illumination line
355 capacitance
365 TFT
370 TFT
375 TFT
380 OLED
401 shift register
402 gate enable circuit
403 first reset enable circuit
404 second reset enable circuit
405 gate buffer
406 first reset buffer
407 second reset buffer
601 input pulse
602 clock
603 shift pulse of shift register
604 shift register output pulse
605 shift register output pulse
606 shift register output pulse
701 output pulse
702 output pulse
703 enable control line
704 enable control line
705 first reset control line
706 second reset control line
707 precharge control line
708 data potential
1001 first video circuit
1002 second video circuit
1003 first video circuit
1004 second video switch
1101 input pulse
1102 clock
1103 input pulse
1104 switching signal
1105 video signal
1106 video signal
1401 current value prediction circuit
1402 comparison circuit
1403 reset period

The invention claimed is:

1. An active matrix type display device comprising:

an active matrix type display array made up of pixel circuits arranged in a row and column matrix form, each pixel circuit includes a current-driven diode type light-emitting element and a plurality of thin-film transistor for controlling the diode type light-emitting element;

a data line provided for each column of the matrix for supplying a data signal to the pixel circuits on the corresponding column;

a data driver for controlling the supply of the data signal to the data line;

a gate line provided for each row of the matrix for supplying a selection signal to pixel circuits on the corresponding row;

a gate driver for supplying the selection signal to the gate line; and a control circuit for controlling the data driver and gate driver, wherein the data driver switches a plurality of sets of video signals alternately and supplies the video signals to the data line, wherein the data driver further switches between the plurality of sets of video signals at least for each frame or each line and supplies the video signals to the data line, wherein the pixel circuit comprises:

a storage capacitance, the potential at one end of which is fixed to a predetermined potential;

a gate transistor, having one non-control terminal connected to a non-fixed potential terminal of the storage capacitance, an other non-control terminal connected to the data line and a control terminal connected to the gate line;

a drive transistor, having its control terminal connected to a non-fixed potential terminal of a reset capacitance and the non-control terminal connected to a power line, for controlling a drive current to the diode type light-emitting element;

an ON control transistor, having its control terminal connected to the ON line, one non-control terminal connected to the other non-control terminal of the drive transistor, and the other non-control terminal connected to the diode type light-emitting element, for controlling ON/OFF of the drive current of the diode type light-emitting element; and a reset transistor, having its control terminal connected to a first reset line, one non-control terminal connected to the other non-control terminal of the drive transistor and the non-control terminal of the ON control transistor, and an other non-control terminal connected between the control terminal of the drive transistor and the non-fixed potential terminal of the reset capacitance.

2. The active matrix type display device according to claim 1:

wherein the plurality of sets of video signals include a first set and a second set, in the data driver, for an odd frame, the first data line on an odd line supplies the first set video signals, the second data line of the same color adjoining the first data line supplies the second set video signals, the first data line on an even line supplies the second set video signals and the second data line supplies the first set video signals, and for an even frame, the first data line on an odd line supplies the second set video signals, the second data line supplies the first set video signals, the first data line on an even line supplies the first set video signals and the second data line supplies the second set video signals.

3. The active matrix type display device according to claim 1, wherein the diode type light-emitting element is an organic EL element.

* * * * *